US009412528B2

(12) United States Patent
Wu et al.

(10) Patent No.: US 9,412,528 B2
(45) Date of Patent: Aug. 9, 2016

(54) SWITCH STRUCTURE

(71) Applicant: SWITCHLAB INC., New Taipei (TW)

(72) Inventors: Chih-Yuan Wu, New Taipei (TW); Sheng-Nan Hou, New Taipei (TW)

(73) Assignees: Switchlab Inc., New Taipei (TW); Switchlab (Shanghai) Co., Ltd., Shanghai (CN)

( * ) Notice: Subject to any disclaimer, the term of this patent is extended or adjusted under 35 U.S.C. 154(b) by 46 days.

(21) Appl. No.: 14/311,448

(22) Filed: Jun. 23, 2014

(65) Prior Publication Data

US 2015/0008108 A1 Jan. 8, 2015

(30) Foreign Application Priority Data

Jul. 2, 2013 (TW) ..... 102123722 A

(51) Int. Cl.

| | |
|---|---|
| ***H01H 1/58*** | (2006.01) |
| ***H01H 9/02*** | (2006.01) |
| ***H01H 19/64*** | (2006.01) |
| ***H01R 4/38*** | (2006.01) |

(52) U.S. Cl.

CPC ..... *H01H 9/02* (2013.01); *H01H 1/5855* (2013.01); *H01H 19/64* (2013.01); *H01R 4/38* (2013.01); *H01H 9/0264* (2013.01)

(58) Field of Classification Search

CPC ..... H01R 4/34; H01R 4/301; H01R 4/36; H01R 11/12

USPC ..... 200/284; 439/813, 801, 812

See application file for complete search history.

(56) References Cited

FOREIGN PATENT DOCUMENTS

JP 2001338702 * 5/2001 ..... H01R 4/34

* cited by examiner

*Primary Examiner* — Renee Luebke
*Assistant Examiner* — Ahmed Saeed
(74) *Attorney, Agent, or Firm* — Rosenberg, Klein & Lee

(57) ABSTRACT

A switch structure connectable with both bare lead and flat-head terminal lead. The switch structure includes a main body formed with at least one cavity. A retainer member and a conductive metal member are arranged in the cavity for pressing the terminal lead into electrical connection with the conductive metal member. A reciprocally movable carrier body is assembled with the retainer member. The carrier body has an arm assembled with an elastic member. A restriction body is disposed in the cavity. The restriction body is formed with a chamber for receiving the arm and the elastic member of the carrier body. The restriction body restricts the moving direction or distance of the carrier body to increase the structural strength of the switch structure and enhance the lead locking ability of the switch structure.

21 Claims, 8 Drawing Sheets

SWITCH STRUCTURE

BACKGROUND OF THE INVENTION

1. Field of the Invention

The present invention relates generally to a switch structure design, and more particularly to an improved switch (cam) device in which a lead can be inserted and electrically connected. The switch device has a restriction body for guiding the carrier body. The switch device is applicable to both flat-head terminal lead and bare lead.

2. Description of the Related Art

A conventional switch or cam switch is applied to electrical engineering, electronic engineering and automatic control system for an operator to controllably switch on/off the console.

The conventional switch includes an insulation housing 10 generally made of plastic material. The housing 10 is formed with multiple cavities 11 in which a conductive metal member 20, a washer 30 assembled on the conductive metal member 20 and an adjustment screw 35 are mounted. In addition, the housing 10 is formed with multiple perforations 12 corresponding to the cavities 11 for the terminal leads to insert into the cavities 11. By means of operating the screw 35, the washer 30 is moved to press the terminal lead into electrical connection with the conductive metal member 20.

As shown in FIGS. 1 and 2, a rotary switch 13 and a cam 14 are disposed on the housing 10. When operating the rotary switch 13 to drive and rotate the cam 14, an operator can selectively controllably switch on/off every conductive metal member 20 mounted in the cavity 11. As known by those who are skilled in this field, multiple housings 10 can be stacked and plug-connected with each other to form multiple layers of housings 10. For example, as shown in FIG. 1, the housings 10 are stacked and assembled to form two layers of housings 10.

The conventional switch has a problem in structural design and application. That is, when multiple layers of housings 10 are applied to the automatic control system, the thickness or height of the housing 10 is limited within about 1 cm~1.5 cm. Such limitation not only affects the operation space of the screw 35, but also leads to limitation of the form of the lead inserted in the cavity 11 for electrically connecting with the conductive metal member 20.

Please refer to FIGS. 2 and 3. In order to smoothly insert the terminal lead through the perforation 12 into the cavity 11 between the conductive metal member 20 and the washer 30, an operator will instinctively unscrew the screw 35. This often causes the screw 35 to drop out of the housing 10. For overcoming this problem of the conventional switch, when manufacturing the washer 30, the washer is punched and bent to form two arched wing sections 31 perpendicularly extending from the washer 30 for enclosing and restricting the screw 35 from dropping out of the housing 10 in operation. As known by those who are skilled in this field, this will complicate the structure of the washer 30 and increase the manufacturing cost of the washer 30. Moreover, in order to easily punch and bent the washer 30 to form the arched wing sections 31, the washer 30 must have a thin thickness (generally 0.6 mm). This lowers the structural strength of the washer 30 and deteriorates the ability to lock the terminal lead. This is not what we expect.

As aforesaid, when multiple layers of housings 10 are applied to the automatic control system, the thickness or height of the housing 10 is limited. This causes limitation of the operation space of the screw 35. As a result, the washer 30 is only applicable to the flat-head terminal lead such as O-type or Y-type terminal lead. With respect to the bare lead with larger diameter or thickness, it is hard to insert the bare lead into the cavity 11 between the conductive metal member 20 and the washer 30.

The conventional switch structure has some shortcomings in use and structural design that needs to be overcome. It is therefore tried by the applicant to provide an improved switch structure to eliminate the shortcomings existing in the conventional switch structure so as to improve the application and ensure the stability and lead locking ability of the switch structure. Under the limitation of the height of the housing, the switch structure of the present invention has an optimal structural strength and lead locking ability. Moreover, the switch structure of the present invention is simplified so that the manufacturing cost is lowered. In addition, the switch structure of the present invention is easily operable and applicable to both flat-head terminal lead (such as O-type or Y-type terminal lead) and bare lead.

SUMMARY OF THE INVENTION

It is therefore a primary object of the present invention to provide an improved switch structure connectable with both bare lead and flat-head terminal lead. The switch structure includes a main body formed with at least one cavity. A retainer member and a conductive metal member are arranged in the cavity for pressing the terminal lead into electrical connection with the conductive metal member. A reciprocally movable carrier body is assembled with the retainer member. The carrier body has an arm assembled with an elastic member. A restriction body is disposed in the cavity. The restriction body is formed with a chamber for receiving the arm and the elastic member of the carrier body, The restriction body restricts the moving direction or distance of the carrier body to increase the structural strength of the switch structure and enhance the lead locking ability of the switch structure.

In the above switch structure, the restriction body is formed with a chamber in which the arm and the elastic member of the carrier body are disposed. When operating the retainer member, the carrier body is pressed by the retainer member to reciprocally move along the chamber. Accordingly, the carrier body and the retainer member have a flexible operation space, permitting the flat-head terminal lead and bare lead to be inserted into the cavity between the conductive metal member and the carrier body and fixedly locked by the retainer member.

The present invention can be best understood through the following description and accompanying drawings, wherein:

DETAILED DESCRIPTION OF THE PREFERRED EMBODIMENTS

Figure 1:
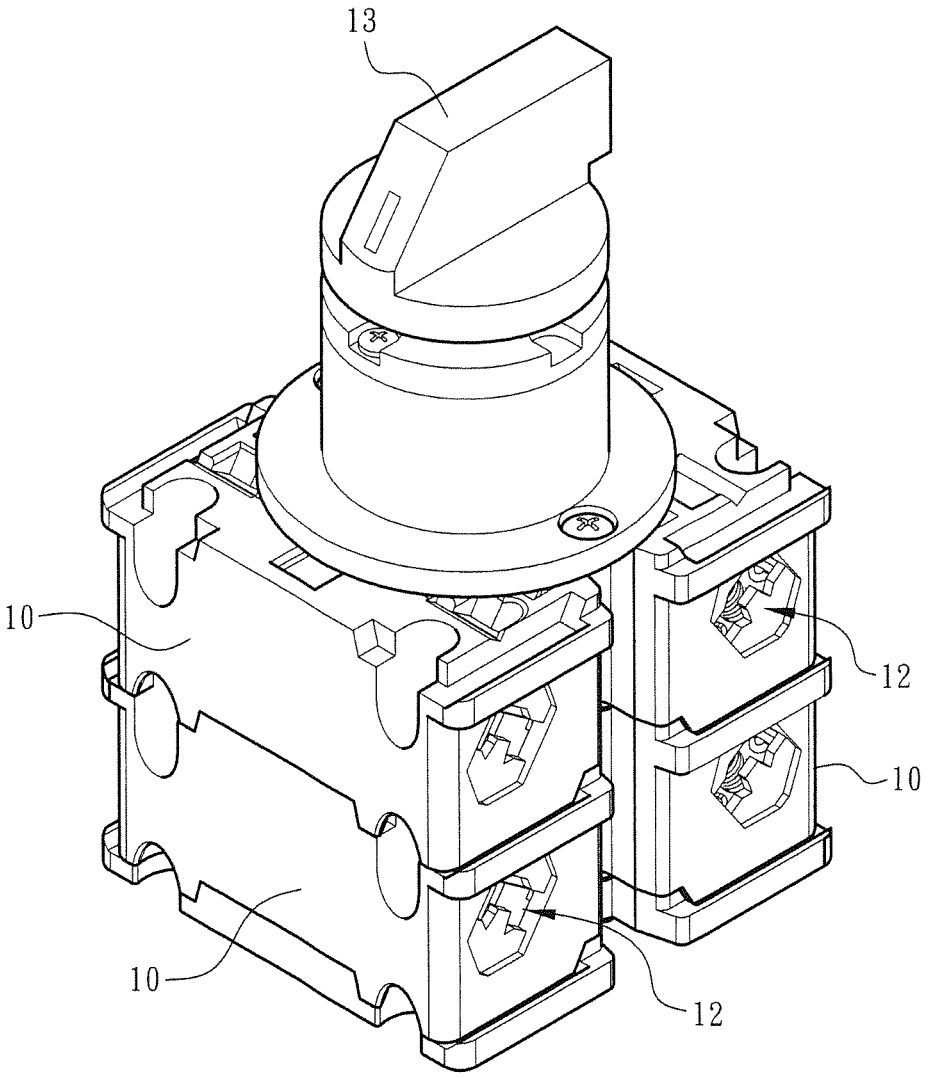
Fig. 1 PRIOR ART
FIG. 1 is a perspective assembled view of a conventional switch structure, showing that a rotary switch is assembled with the housing.
Figure 2:
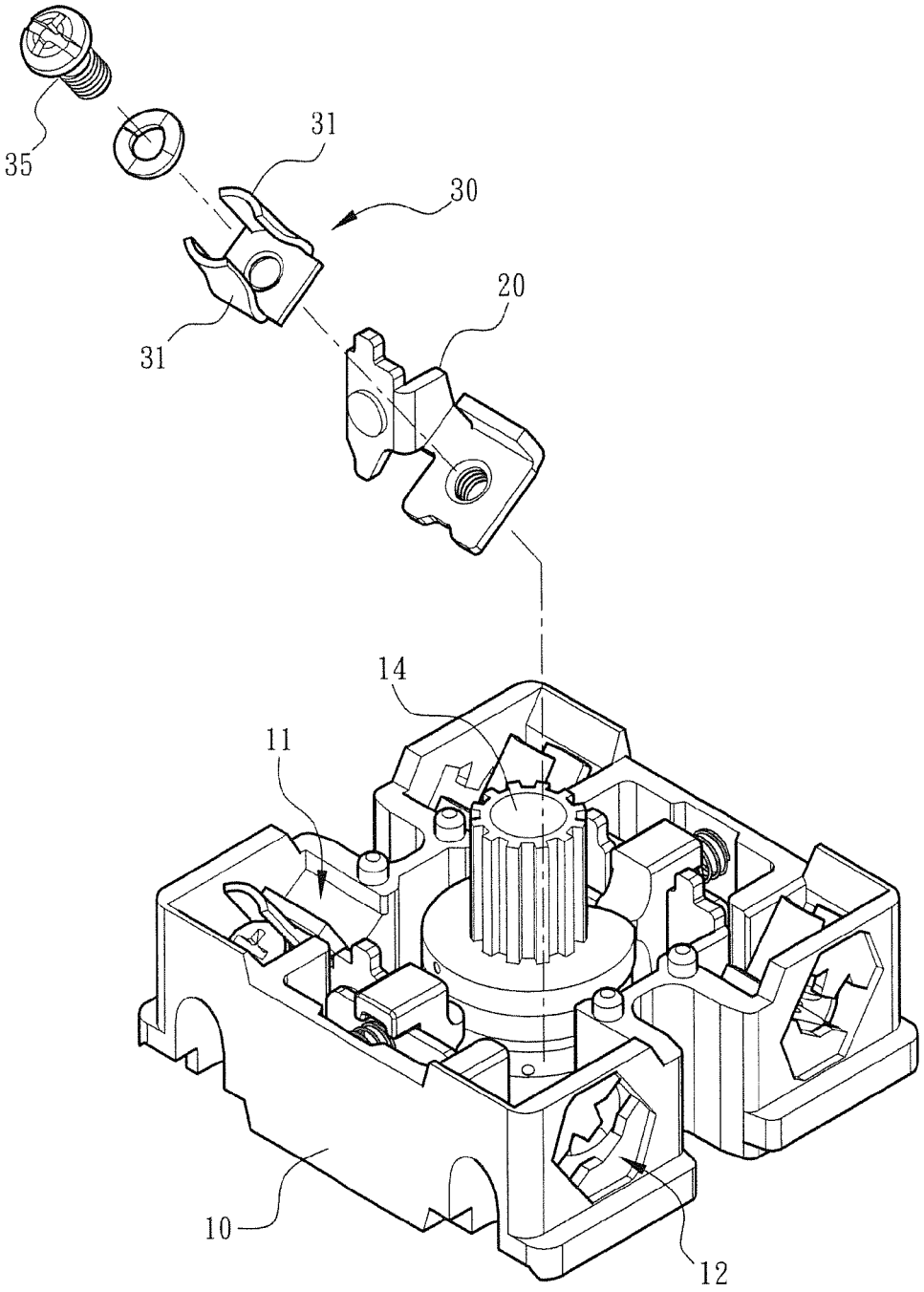
Fig. 2 PRIOR ART
FIG. 2 is a perspective exploded view of the conventional switch structure, showing the housing, the conductive metal member and the washer of the switch in a 180-degree reversed state.
Figure 3:
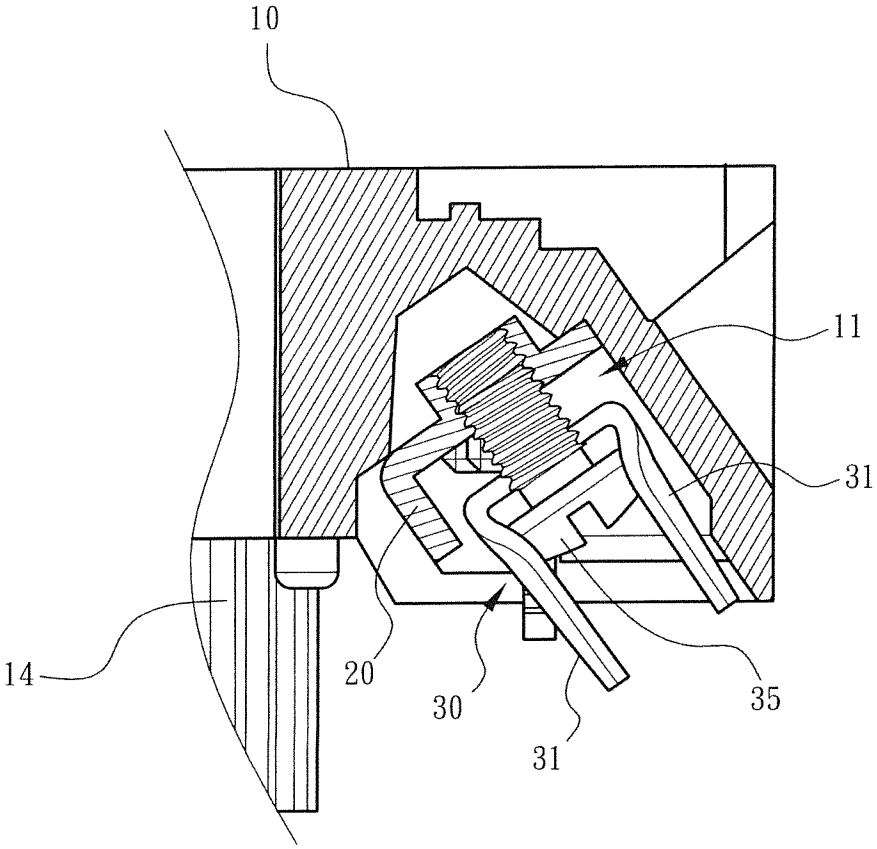
Fig. 3 PRIOR ART
FIG. 3 is a sectional view of the conventional switch structure, showing the cooperation between the housing, the conductive metal member and the washer.
Figure 4:
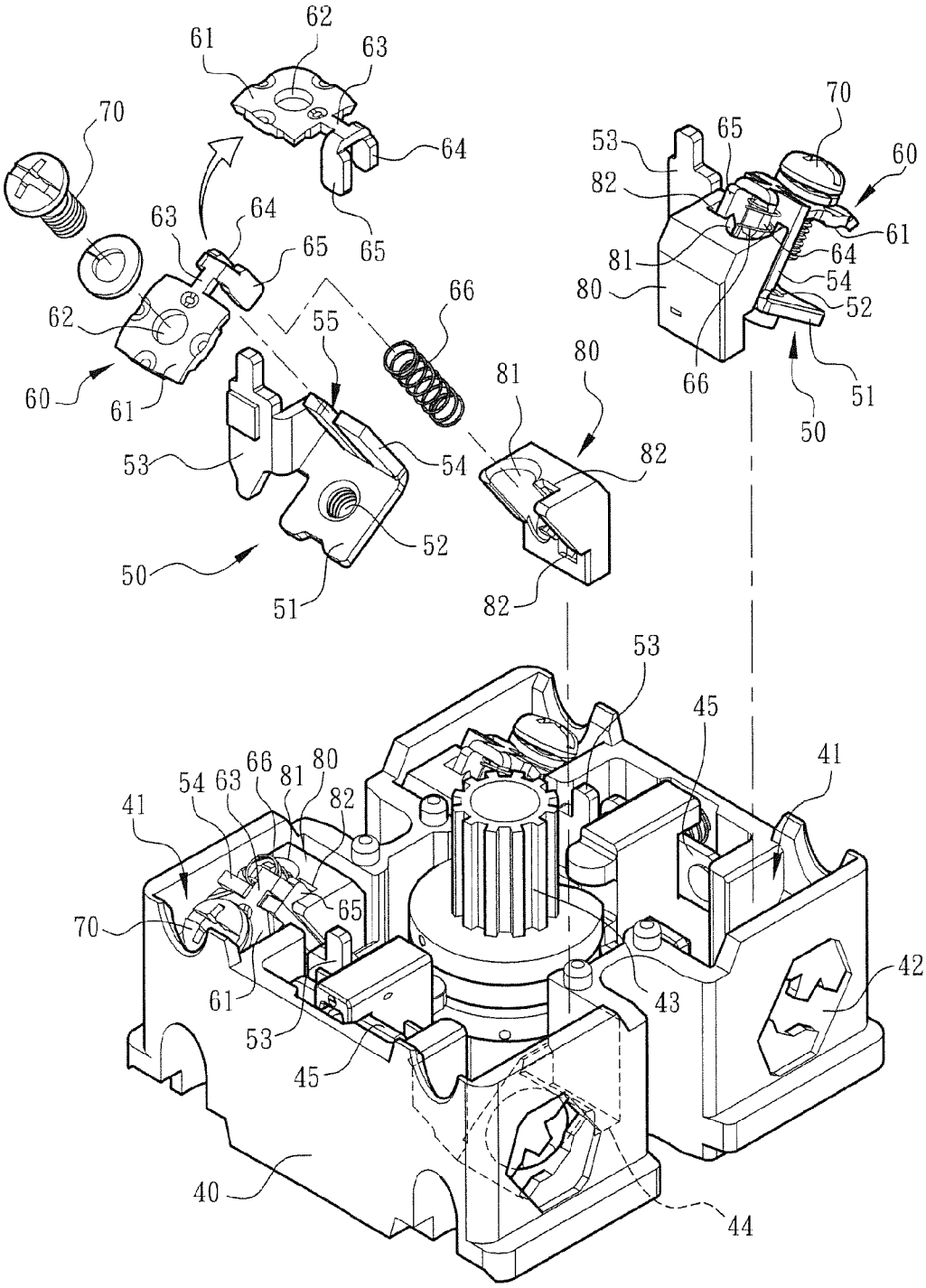
FIG. 4 is a perspective exploded view of the switch structure of the present invention, showing the main body, the conductive metal member and the carrier body of the switch structure in a 180-degree reversed state.
Figure 5:
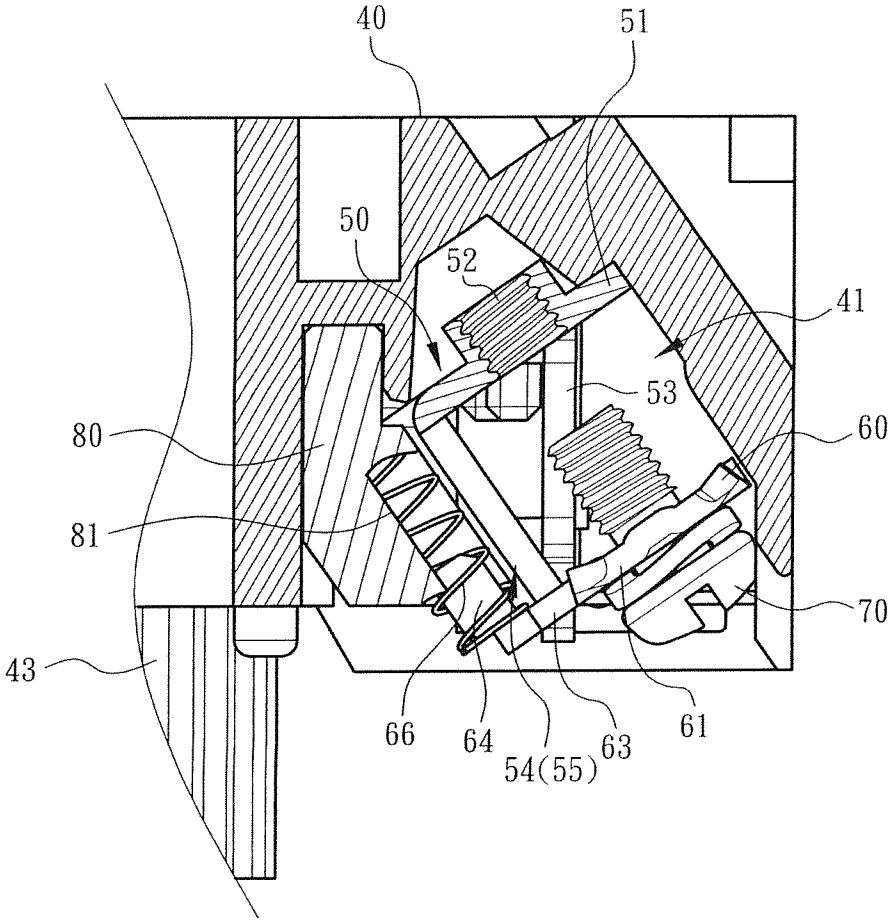
FIG. 5 is a sectional view of the switch structure of the present invention, showing the cooperation between the main body, the conductive metal member, the carrier body and the elastic member.

Please refer to FIGS. 4 and 5. The switch structure of the present invention includes a main body 40 made of insulation material. The main body 40 is formed with multiple cavities 41 and perforations 42 corresponding to the cavities 41 for terminal leads to insert into the cavities 41. In the cavities 41 are mounted conductive metal members 50, carrier bodies 60 assembled with the conductive metal members 50 and retainer members 70.

In this embodiment, the retainer member 70 is in the form of a screw. After the terminal lead is inserted into the cavity 41 through the perforation 42, the retainer member 70 can be operated to make the carrier body 60 press and fix the terminal lead, whereby the terminal lead is electrically connected with the conductive metal member 50. Moreover, as in the conventional operation mode, a cam 43 assembled on the main body 40 can be rotated to selectively controllably switch on/off every conductive metal member 50 mounted in the cavity 41.

As shown in the drawings, the conductive metal member 50 includes a plane 51 and a pivot hole 52 (or threaded hole) formed on the plane 51. When operating the retainer member 70 to move forward, the retainer member 70 is pivotally connected to the pivot hole 52. The conductive metal member 50 has a contact pin 53 for electrically contacting a conductive plate 45 disposed in the main body 40 as shown in FIG. 4.

In this embodiment, the conductive metal member 50 is formed with a wall 54 normal to the plane 51 and a notch 55 formed on the wall 54. The carrier body 60 is formed with a carrier face 61 and a neck section 63 protruding from the carrier face 61 corresponding to the plane 51 and notch 55 of the conductive metal member 50. The neck section 63 is movable within the notch 55.

To speak more specifically, the carrier face 61 is formed with a hole 62 corresponding to the pivot hole 52 of the conductive metal member 50 for assembling with the retainer member 70. When operating the retainer member 70 to move forward, the retainer member 70 will press and move the carrier body 60 to make the neck section 63 move along the notch 55. This will be further described hereinafter.

FIG. 4 also shows that the carrier body 60 has an arm 64 and a subsidiary arm 65 disposed at a rear end of the neck section 63 in parallel to each other. The arm 64 and the subsidiary arm 65 are normal to the carrier face 61. In this embodiment, the arm 64 has a length shorter than that of the subsidiary arm 65. An elastic member 66 is assembled with the arm 64. The elastic member 66 has the form of a spring.

In a preferred embodiment, the cavity 41 is formed with a dent 44 in which a restriction body 80 is disposed for guiding the carrier body 60 to move a certain direction by a certain distance. The restriction body 80 can be integrally formed with the main body 40. In consideration of the injection molding operation, alternatively, the restriction body 80 and the main body 40 can be two pieces that are assembled with each other.

To speak more specifically, the restriction body 80 has the form of a block body, formed with a chamber 81 and a guide channel 82 in adjacency to and in parallel to each other. The chamber 81 serves to receive the arm 64 and elastic member 66 of the carrier body 60. The guide channel 82 serves to receive the subsidiary arm 65 and help in guiding the subsidiary arm 65 to move within the guide channel 82. Accordingly, when operating the retainer member 70, the carrier body 60 can be more stably reciprocally moved.

Figure 6:
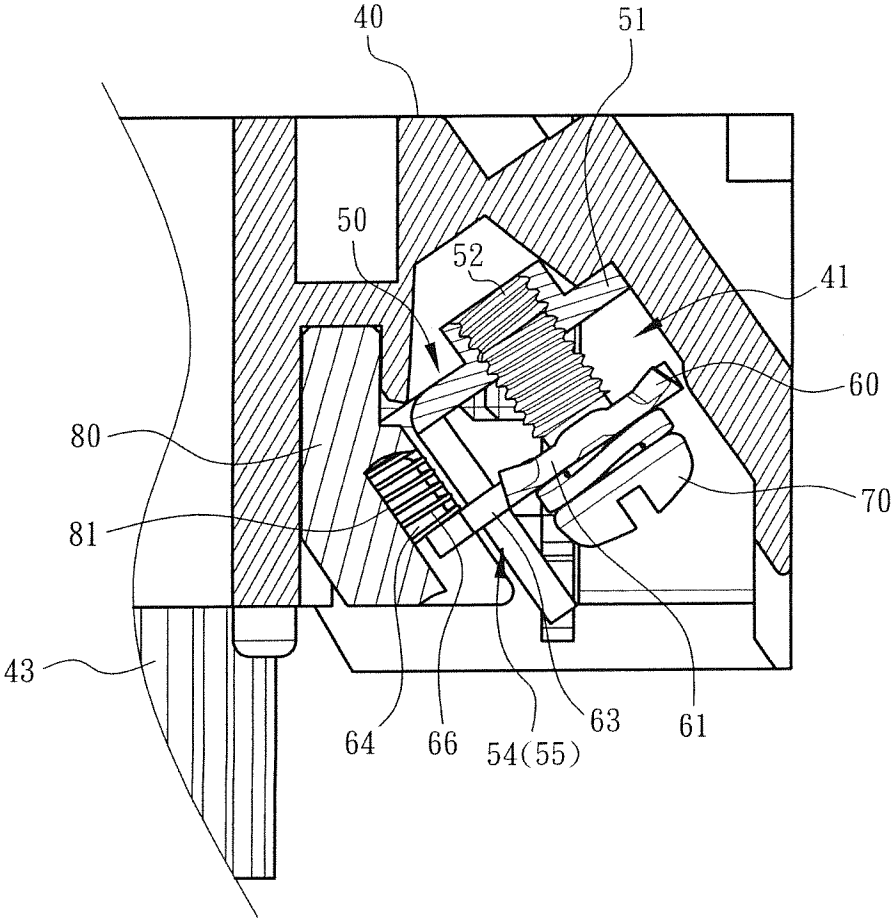
FIG. 6 is a sectional view of the switch structure of the present invention, showing that the retainer member drives the carrier body to move forward and the elastic member is compressed to store energy.

As shown in FIG. 5, the retainer member 70 is passed through the hole 62 of the carrier body and assembled with the carrier body. FIG. 6 shows that when the retainer member 70 is moved forward, the retainer member 70 presses the carrier body 60 to move toward the plane 51 of the conductive metal member 50. At the same time, the arm 64 of the carrier body 60 will compress the elastic member 66 to store energy. FIG. 6 also shows that the retainer member 70 is tightened in the pivot hole 52 of the conductive metal member 50 and fixedly located.

Figure 7:
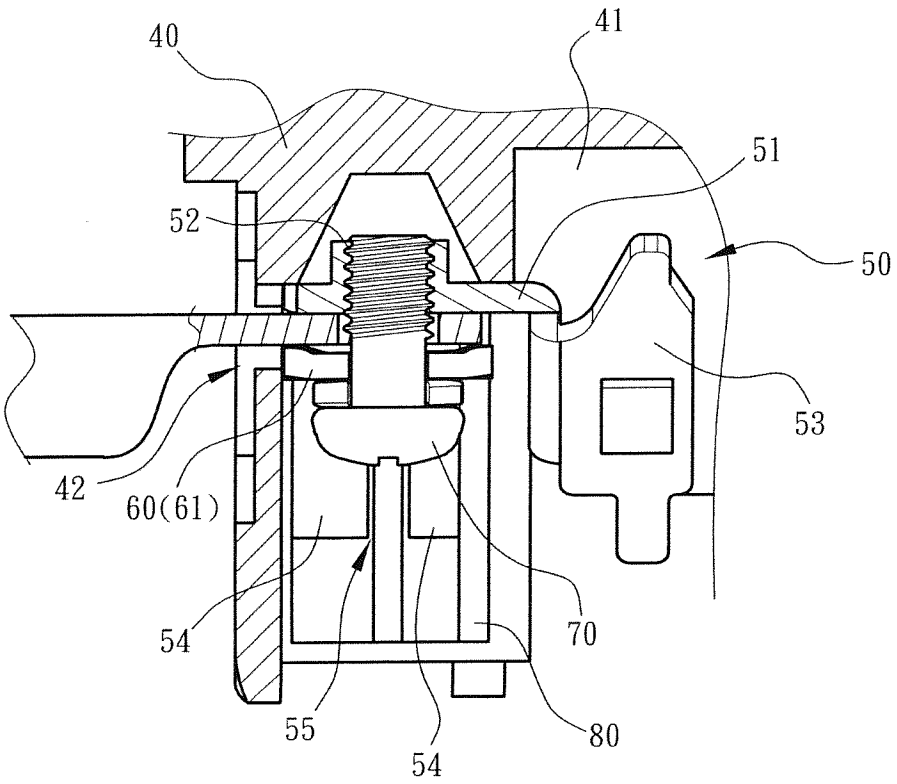
FIG. 7 is a sectional view of the switch structure of the present invention, showing that a flat-head terminal lead is locked between the carrier body and the conductive metal member, in which the flat-head terminal lead is O-type or Y-type terminal lead.
Figure 8:
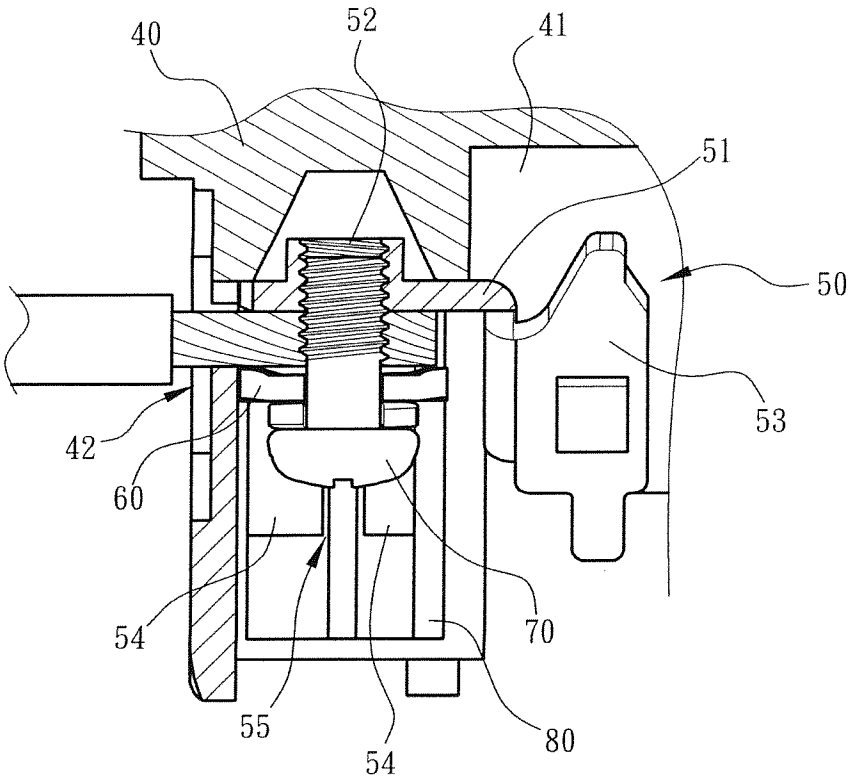
FIG. 8 is a sectional view of the switch structure of the present invention, showing that a bare lead is locked between the carrier body and the conductive metal member.

It should be noted that the arm 64, the elastic member 66 and the subsidiary arm 65 of the carrier body 60 are received in the chamber 81 and the guide channel 82 of the restriction body 80 as shown in FIGS. 5 and 6. Accordingly, when operating the retainer member 70, the carrier body 60 is pressed by the retainer member 70 to reciprocally move along the chamber 81 and the guide channel 82. In this case, the carrier body 60 and the retainer member 70 have a flexible operation space, permitting the flat-head terminal lead (such as O-type or Y-type terminal lead) and bare lead to be inserted into the cavity 41 between the conductive metal member 50 and the carrier body 60 and fixedly locked by the retainer member 70 as shown in FIGS. 7 and 8.

In comparison with the conventional switch structure, the switch structure of the present invention has the following advantages:

1. The switch structure and the relevant components are redesigned and different from the conventional switch structure in use and operation form. For example, the main body 10 is formed with the dent 44 in which the restriction body 80 is disposed. The restriction body 80 is formed with a chamber 81 and a guide channel 82 for receiving the arm 64, the elastic member 66 and the subsidiary arm 65 of the carrier body 60 respectively. The conductive metal member 50 is formed with a notch 55 and the neck section 63 of the carrier body is movable along the notch 55. Accordingly, the application range of the present invention is widened and the structural strength of the present invention is increased to enhance the locking ability and facilitate the operation.
2. In the conventional switch structure, in order to prevent the screw from dropping out of the housing in operation, the washer must be punched and bent. This complicates the structure of the switch and increases the manufacturing cost of the switch. Also, the structural strength of the washer is lowered so that the locking ability for the terminal lead is deteriorated. In contrast, the present invention has higher structural strength so that the above problems are solved.
3. Under the limitation of the height of the switch or housing, the restriction body 80 and the carrier body 60 have such a cooperative structural form that a flexible operation space is formed between the carrier body 60, the retainer member 70 and the conductive metal member 50. Accordingly, the present invention is applicable to flat-head terminal lead such as O-type or Y-type terminal lead and/or bare lead. In contrast, the conventional switch structure is only applicable to flat-head terminal lead so that it is inconvenient for a user to choose the lead.

In conclusion, the switch structure of the present invention is different from the conventional switch structure in space form and is advantageous over the conventional switch structure.

The above embodiments are only used to illustrate the present invention, not intended to limit the scope thereof. Many modifications of the above embodiments can be made without departing from the spirit of the present invention.

What is claimed is:

1. A switch structure comprising:

a main body, the main body being formed with at least one cavity and at least one perforation corresponding to the cavity, a retainer member and a conductive metal member being arranged in the cavity, the conductive metal member being formed with a wall and a notch formed on the wall;

a reciprocally movable carrier body assembled with the retainer member, the carrier body being formed with a carrier face and a neck section protruding from the carrier face, the neck section having a rear end, the rear end of the neck section having an arm assembled with an elastic member, whereby the neck section is movable within the notch; and a restriction body disposed in the cavity, the restriction body being formed with a chamber for receiving the arm and the elastic member of the carrier body.

2. The switch structure as claimed in claim 1, wherein the conductive metal member includes a plane and a pivot hole formed on the plane, the conductive metal member having a contact pin for electrically contacting a conductive plate disposed in the main body.

3. The switch structure as claimed in claim 2, wherein the wall is normal to the plane.

4. The switch structure as claimed in claim 2, wherein the carrier face being formed with a hole corresponding to the pivot hole of the conductive metal member for assembling with the retainer member.

5. The switch structure as claimed in claim 4, wherein a subsidiary arm is formed at the rear end of the neck section, the arm and the subsidiary arm being in parallel to each other and normal to the carrier face, the arm having a length shorter than a length of the subsidiary arm.

6. The switch structure as claimed in claim 1, wherein the carrier body is further formed with a subsidiary arm in parallel to the arm.

7. The switch structure as claimed in claim 2, wherein the carrier body is further formed with a subsidiary arm in parallel to the arm.

8. The switch structure as claimed in claim 1, wherein the elastic member has the form of a spring.

9. The switch structure as claimed in claim 1, wherein the cavity is formed with a dent in which the restriction body is disposed.

10. The switch structure as claimed in claim 1, wherein the restriction body is integrally formed with the main body.

11. The switch structure as claimed in claim 1, wherein the restriction body is formed with a chamber and a guide channel, the chamber serving to receive the arm and the elastic member of the carrier body.

12. The switch structure as claimed in claim 5, wherein the restriction body is formed with a chamber and a guide channel, the chamber serving to receive the arm and the elastic member of the carrier body, the guide channel serving to receive the subsidiary arm, whereby the subsidiary arm is movable within the guide channel.

13. The switch structure as claimed in claim 6, wherein the restriction body is formed with a chamber and a guide channel, the chamber serving to receive the arm and the elastic member of the carrier body, the guide channel serving to receive the subsidiary arm, whereby the subsidiary arm is movable within the guide channel.

14. The switch structure as claimed in claim 7, wherein the restriction body is formed with a chamber and a guide channel, the chamber serving to receive the arm and the elastic member of the carrier body, the guide channel serving to receive the subsidiary arm, whereby the subsidiary arm is movable within the guide channel.

15. The switch structure as claimed in claim 11, wherein the restriction body has the form of a block body and the chamber and the guide channel are in adjacency to and in parallel to each other.

16. The switch structure as claimed in claim 12, wherein the restriction body has the form of a block body and the chamber and the guide channel are in adjacency to and in parallel to each other.

17. The switch structure as claimed in claim 13, wherein the restriction body has the form of a block body and the chamber and the guide channel are in adjacency to and in parallel to each other.

18. The switch structure as claimed in claim 14, wherein the restriction body has the form of a block body and the chamber and the guide channel are in adjacency to and in parallel to each other.

19. The switch structure as claimed in claim 1, wherein the retainer member makes the carrier body and the conductive metal member clamp and lock a flat-head terminal lead.

20. The switch structure as claimed in claim 1, wherein the retainer member makes the carrier body and the conductive metal member clamp and lock a bare lead.

21. The switch structure as claimed in claim 2, wherein the pivot hole is a threaded hole and the retainer member is tightened in the pivot hole of the conductive metal member.

* * * * *